US011867178B2

(12) United States Patent
Borriello et al.

(10) Patent No.: US 11,867,178 B2
(45) Date of Patent: Jan. 9, 2024

(54) SCREW-SPINDLE PUMP, PARTICULARLY FOR COOLING SYSTEMS

(71) Applicant: FLUID-O-TECH S.R.L., Corsico (IT)

(72) Inventors: Pasquale Borriello, Milan (IT); Jacopo Varriale, Pavia (IT); Pierpaolo Lucchesi, Milan (IT); Francesco Tirelli, Arese (IT); Diego Andreis, Milan (IT)

(73) Assignee: FLUID-O-TECH S.R.L., Corsico (IT)

( * ) Notice: Subject to any disclaimer, the term of this patent is extended or adjusted under 35 U.S.C. 154(b) by 0 days.

(21) Appl. No.: 17/870,032

(22) Filed: Jul. 21, 2022

(65) Prior Publication Data

US 2023/0023855 A1 Jan. 26, 2023

(30) Foreign Application Priority Data

Jul. 26, 2021 (IT) ..... 102021000019787

(51) Int. Cl.
*F04C 2/16* (2006.01)
*F04C 15/00* (2006.01)
*F04C 15/06* (2006.01)

(52) U.S. Cl.
CPC ..... *F04C 2/16* (2013.01); *F04C 15/0049* (2013.01); *F04C 15/06* (2013.01); *F04C 2230/21* (2013.01); *F04C 2240/20* (2013.01); *F04C 2240/30* (2013.01)

(58) Field of Classification Search
CPC ..... F01C 21/02; F01C 1/16; F04B 39/121
See application file for complete search history.

(56) References Cited

U.S. PATENT DOCUMENTS

| | | | | |
|---|---|---|---|---|
| 3,084,851 | A | 4/1963 | Schibbye et al. | |
| 4,671,749 | A * | 6/1987 | Naraki | F04C 18/16 418/149 |
| 6,364,645 | B1 * | 4/2002 | Dieterich | F01C 21/10 418/97 |
| 2002/0044876 | A1 | 4/2002 | Yoshimura | |
| 2006/0018773 | A1 | 1/2006 | Yoshimura | |
| 2012/0003112 | A1 * | 1/2012 | Hayashimoto | F04C 2/1071 418/166 |
| 2016/0123327 | A1 * | 5/2016 | Collins | F04C 23/005 418/201.1 |
| 2016/0348675 | A1 * | 12/2016 | Ishii | F04C 11/001 |
| 2019/0323503 | A1 * | 10/2019 | Scala | F04C 2/16 |

FOREIGN PATENT DOCUMENTS

| | | | |
|---|---|---|---|
| CN | 112746958 | A | 5/2021 |
| DE | 1428026 | A1 | 12/1968 |
| DE | 102019103470 | A1 | 8/2020 |
| EP | 2784266 | A2 | 10/2014 |
| WO | 2020053976 | A1 | 3/2020 |

* cited by examiner

*Primary Examiner* — Mickey H France
*Assistant Examiner* — Dapinder Singh
(74) *Attorney, Agent, or Firm* — CANTOR COLBURN LLP

(57) ABSTRACT

An improved screw-spindle pump, particularly for cooling systems, includes a first screw, a second screw and a pump housing, inside which the first screw and the second screw are rotatably housed between the first screw, the second screw and the pump housing, being defined pumping chambers adapted to move, as a consequence of the rotation of the first screw and the second screw, a fluid from a suction area to a delivery area of the pump.

The pump housing housing the first screw and the second screw is made in one piece.

15 Claims, 4 Drawing Sheets

SCREW-SPINDLE PUMP, PARTICULARLY FOR COOLING SYSTEMS

CROSS-REFERENCE TO RELATED APPLICATIONS

This application is related to and claims the benefit of Italian Patent Application No. 102021000019787, filed on Jul. 26, 2021, the contents of which are herein incorporated by reference in their entirety.

TECHNICAL FIELD

The present disclosure refers to an improved screw-spindle pump, particularly for cooling systems.

BACKGROUND

In order to reduce the environmental impact of motor vehicles, the automotive industry is currently making a huge effort in terms of research and adaptation of production processes, with the aim of moving away from the established internal combustion engine drive in favour of electric vehicles (EV—Electric Vehicles, BEV—Battery Electric Vehicles) and hybrid vehicles (HEV—Hybrid Electric Vehicles).

Any electric or hybrid vehicle comprises at least an electric motor and a battery pack. The longevity, operating efficiency and power delivered by the battery pack strongly depend on the ability of the battery pack to work in a very narrow temperature range centred around 30° C. Considering this need and given the irreversibility linked to the operation of the batteries, the concept of thermal management, known as "Thermal Management (TM)", was born in the electric vehicle sector and in particular in the battery electric vehicles sector.

Given the widespread use of centrifugal pumps in classic water cooling systems in internal combustion vehicles, the use of this type of pumps has also been transferred to cooling systems for electric and hybrid cars.

However, nowadays, the need to have electric cars at an ever lower cost and with greater performance, efficiency and autonomy of operation requires the identification of cooling technologies for electric batteries, and electrical and electronic components in general, that are extremely reliable, efficient and also economically competitive, with particular reference to new technologies related to pumping devices and circulation of coolants that can be alternatives and improvements of centrifugal pumps currently used in Thermal Management (TM) for the automotive sector.

Furthermore, centrifugal pumps have the disadvantage that they operate efficiently within a very narrow range of a specific duty point, which depends on the technical characteristics of the pump itself (e.g. impeller sizing; number, sizes and configuration of the relevant blades; etc.). In fact, when moving away, along the characteristic hydraulic curve of a centrifugal pump, from the so-called "Best Optimal Point—BOP", the efficiency of the centrifugal pumps drops drastically.

SUMMARY

The main task of the present disclosure relates to providing an improved screw-spindle pump, particularly for cooling systems, which is an alternative and an improvement with respect to the centrifugal pumps currently used.

As part of this task, the present disclosure realizes an improved screw-spindle pump that is quiet, compact and light compared to the prior art.

The disclosure further provides an improved screw-spindle pump that is capable of providing the broadest guarantees of reliability and safety when used.

The disclosure also provides an improved screw-spindle pump that is easy to make and is economically competitive when compared with the prior art.

The task disclosed above, and also the advantages mentioned and others which are more apparent below, are achieved by providing an improved screw-spindle pump as described in claim 1.

Other features are provided in the dependent claims.

BRIEF DESCRIPTION OF THE DRAWINGS

Further features and advantages shall be more apparent from the description of a preferred, but not exclusive, embodiment of an improved pump, illustrated merely by way of non-limiting example with the aid of the accompanying drawings, in which.

DETAILED DESCRIPTION OF THE DRAWINGS

Figure 1:
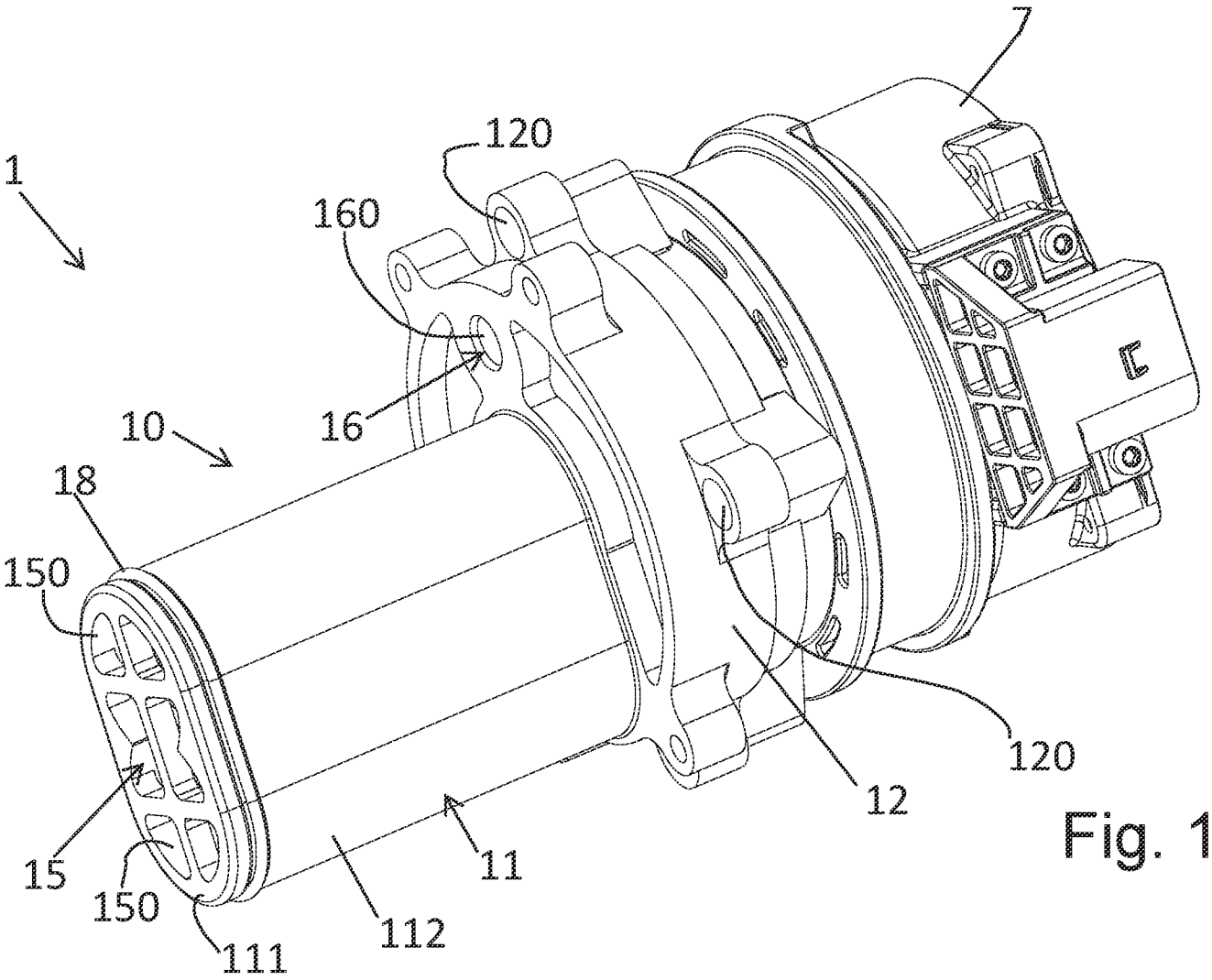
FIG. 1 is a perspective view of an embodiment of an improved screw-spindle pump, according to the disclosure.
Figure 2:
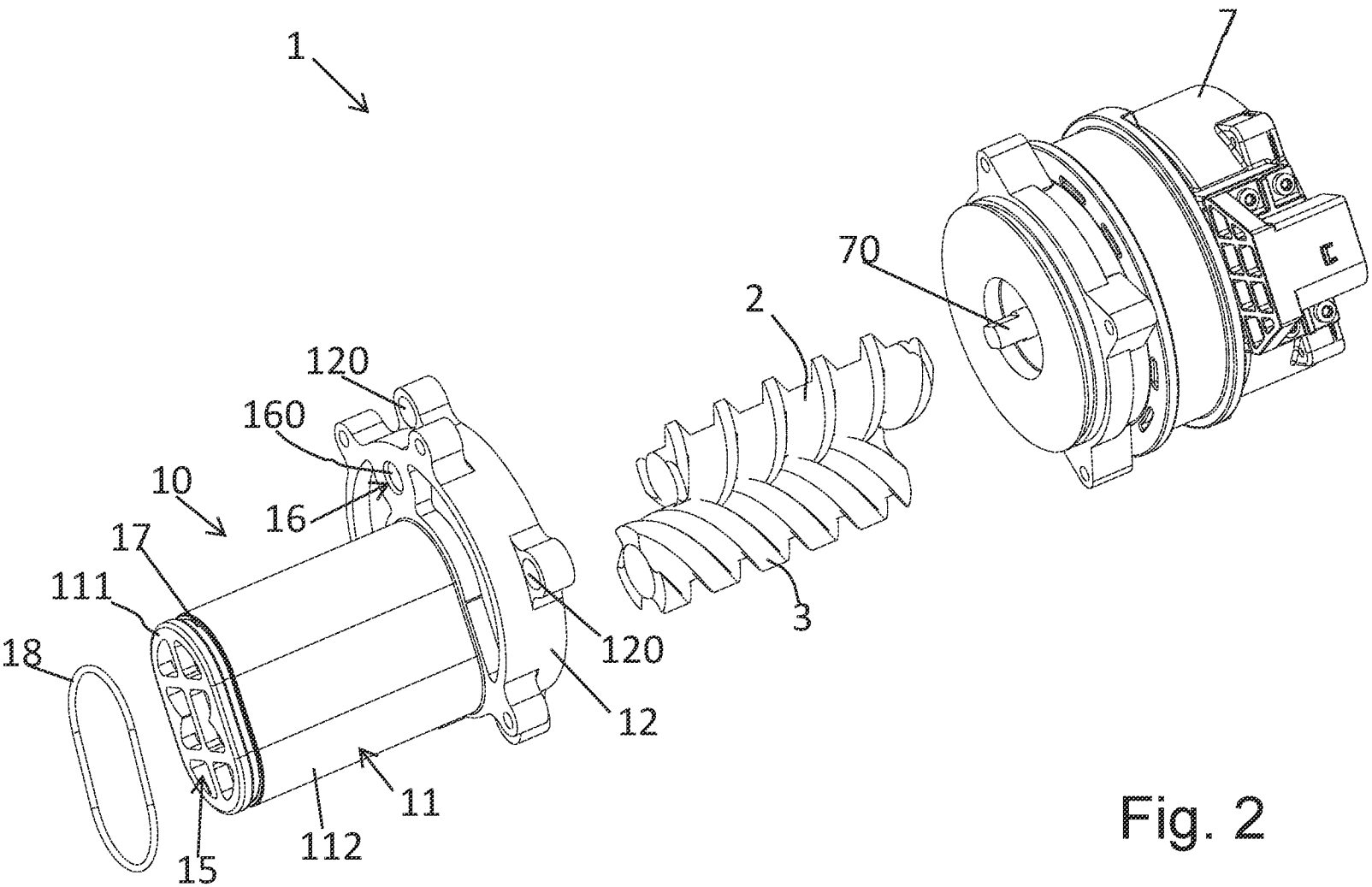
FIG. 2 is a perspective view, in exploded view, of the screw-spindle pump of FIG. 1, according to the disclosure.
Figure 3:
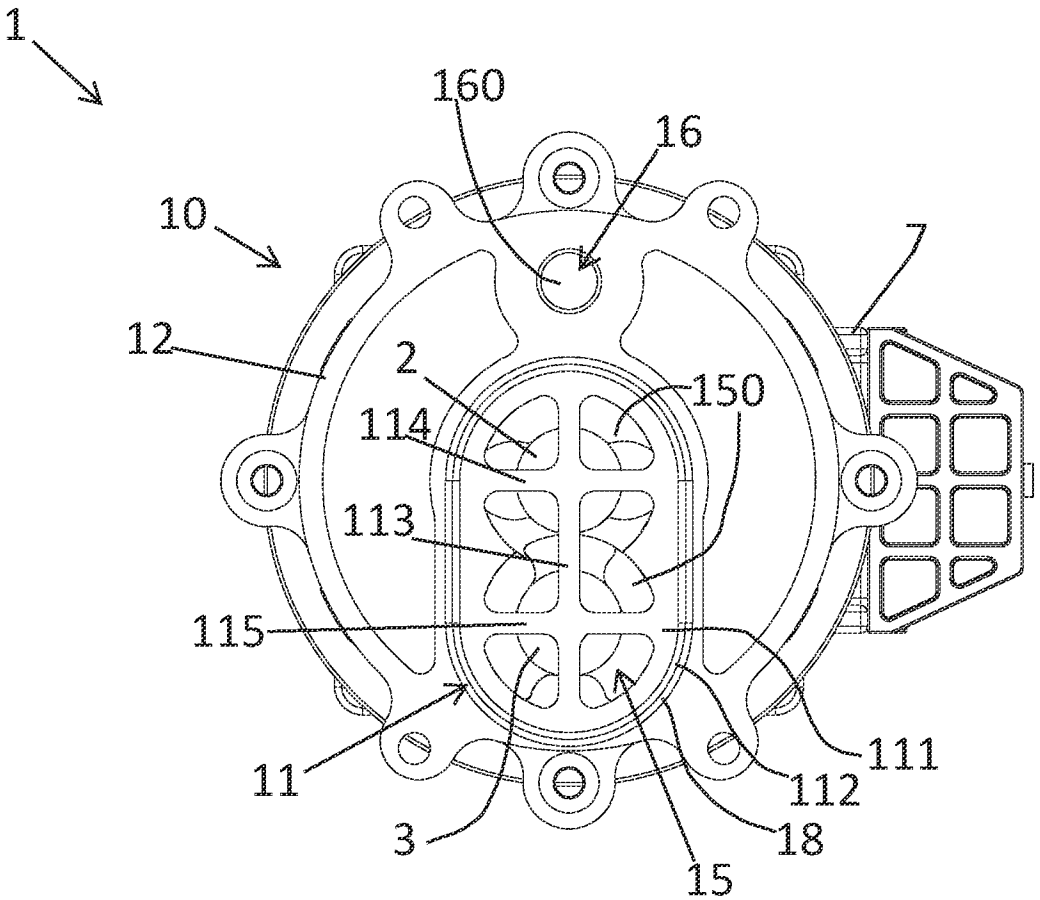
FIG. 3 is a front view of the screw-spindle pump of FIG. 1, according to the disclosure.

With reference to the aforementioned figures, the improved screw-spindle pump, indicated globally with the reference number 1, comprises a first driving screw 2, a second screw 3, meshed with said first screw 2 and dragged by it, and a pump housing 10 inside which the first screw 2 and the second screw 3 are housed so that they can rotate around their central axis. A plurality of pumping chambers 4 adapted to move, as a consequence of the rotation of the first screw 2 and the second screw 3, a fluid from a suction area 5, at low pressure, of the pump 1 to a delivery area 6, at high pressure, of the pump 1 are defined between the first screw 2, the second screw 3 and the pump housing 10. In essence, the intermittent pumping chambers 4, during the rotation of the screws 2 and 3 push in an axial direction, from the suction area 5 to the delivery area 6, the fluid to be pumped, such as for example a coolant of a cooling system.

According to the disclosure, the pump housing 10 housing the first screw 2 and the second screw 3 is made in one piece. Furthermore, according to the disclosure, the pump 1 comprises, in correspondence of respectively the suction area 5 and the delivery area 6, a suction port 15 and a delivery port 16 both obtained directly in the pump housing 10.

In other words, the pump housing 10 integrates, in a single component made in one piece, both the suction port 15 and the delivery port 16.

The fluid is preferably a liquid, and in particular a coolant of the type used in cooling systems, and even more particularly of the type used in the cooling systems for batteries and other electrical and electronic components of electric and hybrid vehicles.

Advantageously, the suction port 15 comprises at least one suction through hole 150 obtained in the pump housing 10. Advantageously, moreover, the delivery port 16 comprises at least one delivery through hole 160 also obtained in the pump housing 10.

Advantageously, the central axes 151 and 161 respectively of the suction through hole 150 and the delivery through hole 160 are parallel to each other and arranged according to an axial direction.

Advantageously, the choice of arranging the suction hole 150 and the delivery hole 160 in an axial direction, and parallel to each other, makes it possible to improve the integration of the pump 1 in the cooling system it is used for, to simplify the installation and disassembly phases of the pump 1 when integrated into the cooling system, as well as to increase the compactness of the pump 1 itself.

Advantageously, the pump housing 10 comprises a base 111, being an integral part of the pump housing 10, and comprising a pair of thrust bearings 13 protruding from the base 111 towards the inside of the pump housing 10, which are adapted to axially support respectively the first screw 2 and the second screw 3 housed inside the pump housing 10.

Advantageously, also these thrust bearings 13 are obtained integrally in the base 111 of the pump housing 10.

The term thrust bearing generally refers to an element adapted to generate an axial abutment for a rotating element, such as a screw of a screw-spindle pump, allowing it to rotate around its axis.

The thrust bearings 13 are obtained in the base 111 in correspondence with the axial ends of the first screw 2 and of the second screw 3, respectively, and are advantageously configured in the form of a pin.

In fact, during the operation of the pump 1, the high pressure of the fluid that is generated in the delivery area 6 exerts a thrust on the screws 2 and 3 towards the suction area 5, at low pressure. The thrust bearings 13 therefore act as end-of-stroke pins on the suction side, to limit the axial displacement of the screws 2 and 3, so as to secure their axial positioning inside the pump housing 10, and to keep passive torques due to frictions and wears under control.

The thrust bearings 13 therefore preferably comprises pins, of substantially cylindrical shape, obtained integrally with the pump housing 10, and more precisely with the relative base 111.

Advantageously, the length of the thrust bearings 13 is sized taking into account the wear due to the sliding contact with the screws 2 and 3 and the total operating hours expected for the pump 1.

The configuration and the positioning of the thrust bearings 13 are also adapted to create a small volume of fluidic tank 9 and to allow conveying part of the incoming fluid from the suction port 15, taking advantage of the specific pressure increase dictated by the thrust of the screws 2 and 3, in this volume 9 so as to lighten the contact forces and therefore the passive torques due to the slidings of the screws 2 and 3.

In other words, the thrust bearings 13 are configured to abut against the axial ends of the screws 2 and 3 so as to create a small volume of fluidic tank 9, whose fluid present therein supports the screws 2 and 3 themselves.

Advantageously, the pump housing 10 comprises a hollow body 11 in which the first screw 2 and the second screw 3 are housed, and a flange 12 configured to be fixed to a motor 7 for driving the first screw 2, i.e. of the driving screw. The hollow body 11 comprises the base 111 and one or more side walls 112. The suction port 15 is obtained in the base 111 of the hollow body 111, while the delivery port 16 is obtained in the flange 12. The delivery port 16 is in fluid communication with the internal volume of said hollow body 11, by means of the fluid communication volume indicated with 162.

As mentioned, the hollow body 11, with its base 111, and the flange 12 are made integrally, in one piece.

Advantageously, the hollow body 11 is a tubular body whose cross-section is preferably elliptical, or substantially circular in shape, and such that it accommodates the two screws 2 and 3.

Advantageously, the screw-spindle pump 1 also comprises the motor 7, which is fixed to the pump housing 10, and in particular to the flange 12 thereof, preferably by means of screws, not illustrated in the accompanying figures, passing through holes 120 obtained in the flange 12.

Figure 4:
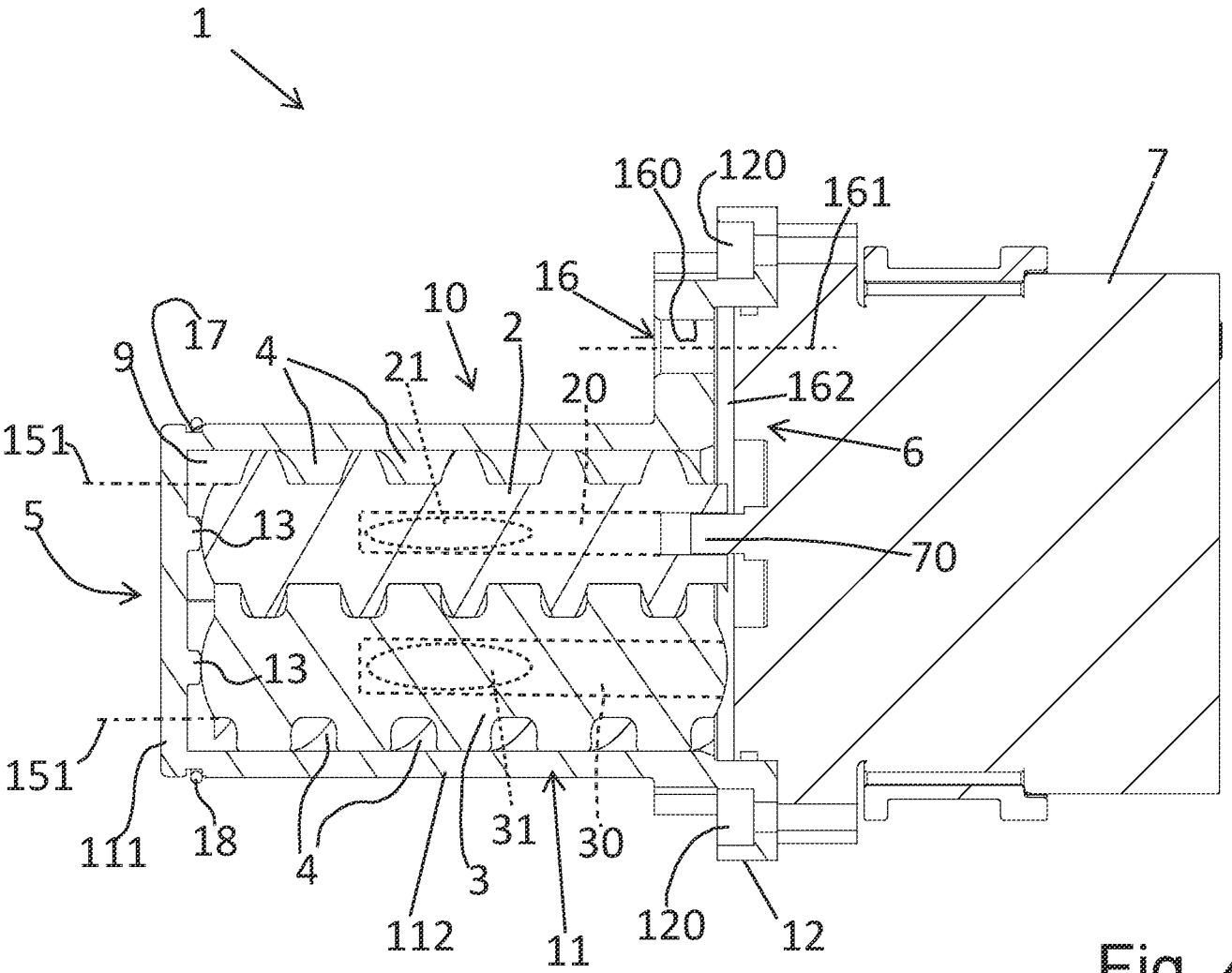
FIG. 4 is a cross-sectional view of the screw-spindle pump of FIG. 1, according to the disclosure.

As illustrated in particular in FIG. 4, the volume of fluid communication 162 that puts the delivery port 16 in communication with the internal volume of the pump housing 10 is defined in part by the pump housing 10 itself, and in particular by the flange 12, and in part by the motor 7 (or motor-group).

Advantageously, therefore, in correspondence with the delivery area 6, the pumped fluid also reaches the motor 7 for driving the first screw 2.

Advantageously, in fact, the high-pressure fluid present in the delivery area 6 is free to enter and recirculate within the motor 7, providing hydrodynamic support of the relative rotating and/or floating components, such as bushings and magnet, as well as guaranteeing the cooling thereof with beneficial effects on the performance and reliability of the motor 7 itself.

Advantageously, the motor 7 is an electric motor.

Preferably the motor 7 is a variable speed electric motor, adapted to generate flows at variable flow rate of the screw-spindle pump 1.

Advantageously, the shaft 70 of the motor 7 sets the driving screw 2 in motion by means of a suitable shape coupling aimed at ensuring the dragging thereof and limiting any radial misalignments.

Alternatively, the driving screw 2 can be put in rotation by means of a magnetic dragging motor, thus without shape couplings between a rotation shaft of the motor and the driving screw itself, so as to further reduce the risks of failure and reduce encumbrances.

Advantageously, the suction port 15 obtained in the base 111 of the pump housing 10 is crossed by at least one bracket 113, 114, 115 to which the thrust bearings 13 are associated. Preferably, the suction port 15 is crossed by a plurality of brackets 113, 114, 115 that are incident (or orthogonal) to each other and configured to define a support structure for the thrust bearings 13, as well as configured to define a plurality of suction through holes 150.

As illustrated in the accompanying figures, the suction port 15 advantageously comprises a plurality of voids, that is of a plurality of through holes 150, present in the base 111 of the pump housing 10, and reciprocally separated from each other by one or more brackets 113, 114 and 115 to which the thrust bearings 13 are associated. In other words, in the suction port 15 there are one or more brackets 113, 114 and 115, made integrally with the pump housing 10 itself, and in particular with the relative base 111, which brackets define a plurality of suction holes 150 between them.

Advantageously, the pump housing 10 comprises a perimeter groove 17 adapted for receiving a sealing gasket 18, such as for example a radial o-ring.

This sealing gasket 18 is adapted to guarantee the seal of the pump 1 towards the external environment, and in particular towards the duct that carries the cooling fluid, in order to guarantee the priming capacity of the pump 1 itself.

Advantageously, as illustrated in the accompanying figures, the pump housing 10 is a single body, made in one piece. In other words, the hollow body 11, and in particular its side walls 112 and its base 111, with the relative brackets 113, 114, 115 and the thrust bearings 13, as well as the flange 12 are made in one piece, as a single body.

Advantageously, the pump housing 10 is made of a polymeric material through a molding process, in a single mold, preferably an injection molding process.

Advantageously, the first screw 2 and/or the second screw 3 are made of a polymeric material through a molding process, preferably an injection molding process, in a single mold.

Preferably, each of the pump housing 10 and the two screws 2, 3 are made of a polymeric material through a molding process, preferably an injection molding process, in a single mold.

Advantageously, the mechanical and tribological properties of the polymeric material used for the molding of the pump housing 10, first screw 2 and/or second screw 3 are such as to guarantee high dimensional tolerances in order to be able to ensure the required hydraulic performance and the proper functioning of the pumping elements.

The choice of the polymeric material for the realization of the pump housing 10, as well as for the realization of the screws 2, 3 allows the pump 1 to have reduced weights, low costs, high precisions, minimum distortions, long operating life, as well as an excellent tribological behaviour in the screw-screw and screws-pump housing coupling.

Alternatively, at least one of the following components of the screw-spindle pump 1 may be made of metal or a metal alloy: pump housing 10, first screw 2 and second screw 3.

Advantageously, such metal can be steel.

For example, in one embodiment of the screw-spindle pump 1, the pump housing 10 is made of a polymeric material, while the two screws 2 and 3 are made of metal or a metal alloy, and preferably they are made of steel.

Advantageously, the first screw 2 and/or the second screw 3 are internally hollow. Preferably both screws 2 and 3 are internally hollow.

Advantageously, the screws 2, 3 are made with percentages of reduction of the internal core that reach up to at least 80% of the length of the screw 2, 3 itself, in order to minimize the weights, the use of material and the realization times in the molding phase.

As schematically illustrated in FIG. 4, the screw 2, or the screw 3, or both, comprise an internal cavity, indicated by 20 and 30, respectively. Preferably, said internal cavity 20, 30 is in fluid communication with the internal volume of the pump housing 10. Advantageously, in fact, the internal cavity 20, 30 comprises at least one opening adapted to allow the fluid present inside the pump housing 10 to penetrate inside the internal cavity 20 or 30 itself.

Advantageously, the internal cavity 20, 30 contains deformable elements 21, 31 adapted for absorbing any residual pulsations generated in the fluid pumped by the pump 1.

Advantageously, the moulding technique of the pump housing 10 allows to integrate, in the moulding phase of the pump housing 10 itself, also the so-called hose carriers necessary for the connection of the pump 1 to the circuit of the cooling system, so as to further reduce the number of components of the cooling system in the case of connection to the cooling tubes.

Advantageously, support elements of the screws 2 and 3 can also be provided in correspondence with the delivery area 6, not illustrated, adapted to stabilize the axial translations of the screws 2 and 3 also in correspondence with the relative ends from the delivery side.

The operation of the screw-spindle pump 1, according to the disclosure, is clear and evident from what is described.

In practice, it has been found that the screw-spindle pump, according to the present disclosure, fulfils the set tasks as well as the intended purposes as it constitutes a valid alternative to centrifugal pumps.

Another advantage of the screw-spindle pump according to the disclosure, is that it has a minimalist design that minimizes the number of components of the pump itself, which in essence are only four: motor, driving screw, dragged screw and pump housing, as well as the screws for fixing the pump housing to the motor and the sealing gasket. This also has a positive impact on the simplicity of producing and sourcing the few components of the pump and in particular on the simplicity of assembly of the same and integration into the cooling systems, in particular for the electric or hybrid vehicle sector.

A further advantage of the screw-spindle pump, according to the disclosure, is that the pump housing, in addition to performing the purely fluidic function, is provided with measures aimed at determining the precise positioning of the screws and controlling the axial translations thereof when they are not dominated by the plays of the pressures of the fluid. Furthermore, the pump housing incorporates in the part facing the motor an interface that ensures its correct alignment by means of mutually engaging portions having precisely selected centring diameters.

The same delivery and suction ports of the pump housing are designed in such a way as to maximise the integration of the component into the cooling system circuit, minimizing its encumbrances. In addition, the suction side of the pump housing is open and exposed to the fluid, which also simplifies the realization of the mold for obtaining the pump housing itself.

Another advantage of the screw-spindle pump, according to the disclosure, is that it achieves good efficiency levels at multiple operating points, both in terms of flow rate and pressure, which cannot be achieved with centrifugal-type pumping technologies.

In fact, the components of the centrifugal pumps are specifically sized so that the pump operates in the close vicinity of the so-called BOP ("Best Optimal Point"), outside of which cavitation, vibration and surge phenomena occur which drastically limit its efficiency. On the contrary, the screw-spindle pump according to the disclosure can operate with high efficiency in wider working ranges and, when provided with a variable speed electric motor, can also generate, without significant repercussions on the overall efficiency, variable delivery flows depending on the application and operational requirements.

A further advantage of the screw-spindle pump, according to the disclosure, is that it is developed mainly in the length direction, rather than in the radial direction, thus enabling an easier installation inside the vehicles and also facilitating the downward distribution of the masses. This is particularly useful in the automotive sector, as the chassis of the electric or hybrid vehicles are configured precisely to allow a lowered positioning of the battery pack. Also the cooling system, thanks to the configuration of the screw-spindle pump in the length direction, can therefore be designed so as to develop in length and to allow a lowered positioning of the battery pack.

The improved screw-spindle pump, particularly for cooling systems thus conceived, is susceptible to changes and variations falling within the scope of the inventive concept. Furthermore, all the details can be replaced by other technically equivalent elements.

In practice, any materials can be used according to requirements, as long as they are compatible with the specific use, the dimensions and the contingent shapes.

The invention claimed is:

1. A screw-spindle pump for cooling systems comprising: a first screw, a second screw and a pump housing inside which said first screw and said second screw are housed, between said first screw, said second screw and said pump housing being defined a plurality of pumping chambers adapted to move, as a consequence of the rotation of said first screw and of said second screw around their respective central axis, a fluid from a suction area to a delivery area of said pump, wherein said pump housing that houses said first screw and said second screw is made of one piece and said pump comprises, in correspondence of respectively said suction area and said delivery area, a suction port and a delivery port both obtained in said pump housing wherein said suction port comprises at least one suction through hole obtained in said pump housing and wherein said delivery port comprises at least one delivery through hole obtained in said pump housing;

wherein the central axes of respectively said suction through hole and said delivery through hole are parallel to each other and arranged in an axial direction, said axial direction being parallel to the central axes of said first screw and said second screw;

wherein said pump housing comprises a hollow body in which said first screw and said second screw are housed and a flange, made as one piece with said hollow body and configured to be fixed to a motor for driving said first screw, said hollow body being a tubular body comprising said a base and one or more side walls, said base, said side walls and said flange being made in one single piece, said suction port being obtained in said base, said delivery port being obtained in said flange, said delivery port being in fluid communication with the internal volume of said hollow body.

2. The screw-spindle pump, according to claim 1, wherein said pump housing comprises a base forming an integral part of said pump housing and comprising a pair of thrust bearings protruding from said base towards the inside of said pump housing adapted to axially support respectively said first screw and said second screw housed inside said pump housing, said thrust bearings being obtained integrally in said base of said pump housing.

3. The screw-spindle pump, according to claim 1, wherein said suction port obtained in said base of said pump housing is crossed by at least one bracket to which said thrust bearings are associated.

4. The screw-spindle pump, according to claim 3, wherein said at least one bracket is integrally obtained in said base of said pump housing.

5. The screw-spindle pump, according to claim 1, wherein said pump housing comprises a perimeter groove adapted for receiving a sealing gasket.

6. The screw-spindle pump, according to claim 1, wherein each of said pump housing and/or said first screw and/or said second screw are made of polymeric material through a molding process, in a single mold.

7. The screw-spindle pump, according to claim 1, wherein said first screw and/or said second screw are internally hollow.

8. The screw-spindle pump, according to claim 1, wherein said first screw and/or said second screw comprises an internal cavity in fluid communication with the internal volume of said pump housing.

9. The screw-spindle pump, according to claim 8, wherein said internal cavity contains a deformable element adapted for absorbing pulsations of said fluid.

10. The screw-spindle pump, according to claim 1, wherein, in correspondence with said delivery area, said fluid reaches said motor for driving said first screw.

11. The screw-spindle pump, according to claim 1, wherein said pump housing comprises a hollow body in which said first screw and said second screw are housed and a flange configured to be fixed to a motor for driving said first screw, said hollow body comprising a base and one or more side walls, said base being crossed by at least one bracket to which thrust bearings are associated and are protruding from said base towards the inside of said pump housing adapted to axially support respectively said first screw and said second screw housed inside said pump housing, wherein: said base, said at least one bracket, said thrust bearings, said side walls and said flange are made in one piece.

12. The screw-spindle pump, according to claim 1, wherein said delivery port comprises at least one delivery through hole obtained in said pump housing at said flange and having its central axis arranged in an axial direction, said delivery port being in fluid communication with the internal volume of said hollow body by means of a volume defined in part by the pump housing including said flange and in part by said motor.

13. A cooling system comprising a screw-spindle pump according to claim 1.

14. A screw-spindle pump for cooling systems comprising: a first screw, a second screw and a pump housing inside which said first screw and said second screw are housed, between said first screw, said second screw and said pump housing being defined a plurality of pumping chambers adapted to move, as a consequence of the rotation of said first screw and of said second screw around their respective central axis, a fluid from a suction area to a delivery area of said pump, wherein said pump housing that houses said first screw and said second screw is made of a single piece and said pump comprises, in correspondence of respectively said suction area and said delivery area, a suction port and a delivery port both obtained in said pump housing, wherein said pump housing comprises a hollow body in which said first screw and said second screw are housed and a flange, made as one piece with said hollow body and configured to be fixed to a motor for driving said first screw, said hollow body being a tubular body comprising a base and one or more side walls, said base, said side walls and said flange being made in one single piece, said suction port being obtained in said base, said delivery port being obtained in said flange;

wherein said suction port comprises at least one suction through hole obtained in said pump housing and wherein said delivery port comprises at least one delivery through hole obtained in said pump housing;

wherein the central axes of respectively said suction through hole and said delivery through hole are parallel to each other and arranged in an axial direction, said axial direction being parallel to the central axes of said first screw and said second screw;

wherein said pump comprises a motor fixed to the pump housing at said flange;

wherein said delivery port comprises at least one delivery through hole obtained in said pump housing at said flange, said delivery port being in fluid communication with the internal volume of said hollow body by means of a volume defined in part by the pump housing including said flange and in part by said motor.

15. A screw-spindle pump for cooling systems comprising: a first screw, a second screw and a pump housing inside which said first screw and said second screw are housed, between said first screw, said second screw and said pump housing being defined a plurality of pumping chambers adapted to move, as a consequence of the rotation of said first screw and of said second screw, a fluid from a suction area to a delivery area of said pump, wherein said pump housing that houses said first screw and said second screw is made of a single piece and said pump comprises, in correspondence of respectively said suction area and said delivery area, a suction port and a delivery port both obtained in said pump housing, wherein said pump housing comprises a base forming an integral part of said pump housing and comprising a pair of thrust bearings protruding from said base towards the inside of said pump housing adapted to axially support respectively said first screw and said second screw housed inside said pump housing, said thrust bearings being obtained integrally in said base of said pump housing, wherein said thrust bearings are configured in the form of pins.

* * * * *